US005944229A

United States Patent [19]

Rokkjaer

[11] Patent Number: 5,944,229

[45] Date of Patent: Aug. 31, 1999

[54] DRUM VALVE SYSTEM WITH TAMPER EVIDENT CAP

[75] Inventor: Henrik Rokkjaer, Northridge, Calif.

[73] Assignee: Micro Matic USA, Inc., Northridge, Calif.

[21] Appl. No.: 08/961,043

[22] Filed: Oct. 30, 1997

[51] Int. Cl.[6] ..... B67D 5/32

[52] U.S. Cl. ..... 222/153.07; 222/400.7; 222/541.9; 220/269

[58] Field of Search ..... 222/153.01, 153.05, 222/153.07, 153.06, 153.14, 400.7, 400.8, 541.6, 541.9; 220/268, 269

[56] References Cited

U.S. PATENT DOCUMENTS

| | | | |
|---|---|---|---|
| 3,659,757 | 5/1972 | Tini | 222/153.07 |
| 4,509,663 | 4/1985 | Fallon | 222/400.7 |
| 4,548,343 | 10/1985 | Gotch | 222/400.7 |
| 4,612,952 | 9/1986 | Fallon | 137/212 |
| 4,715,414 | 12/1987 | Harrison et al. | 222/400.8 |
| 4,784,296 | 11/1988 | Bullock | 222/153.07 |
| 5,203,447 | 4/1993 | Lo | 222/400.7 |
| 5,443,175 | 8/1995 | Kelly et al. | 220/269 |
| 5,497,915 | 3/1996 | Wass | 222/153.07 |

FOREIGN PATENT DOCUMENTS

| | | | |
|---|---|---|---|
| 8002410 | 11/1980 | WIPO | 220/268 |

OTHER PUBLICATIONS

Drum Valve DV–Liquid Transfer Valve System by Micro Matic Group.

*Primary Examiner*—Joseph A. Kaufman
*Attorney, Agent, or Firm*—James E. Brunton

[57] ABSTRACT

A liquid transfer system which minimizes user exposure to hazardous materials, effectively addresses new governmental regulations and provides a positive methods for deterring system tampering. The liquid transfer system includes a novel valve mechanism which can be connected to a container such as a metal or plastic drum, and a coupler mechanism which can be removably coupled with the valve mechanism for operating the valve mechanism. An important aspect of the liquid transfer system is a tamper evident closure cap for closing the top to the dispensing valve mechanism of the system. The tamper evident cap is of a unique character such that it must be broken before access to the container can be achieved. The top opening of the valve mechanism is uniquely configured so that it will accept only couplers of a particular compatible design. In this way, couplers and valves can be custom designed for individual users and use of, or tampering with, containers belonging to the individual user by users of similar systems if positively prevented.

16 Claims, 12 Drawing Sheets

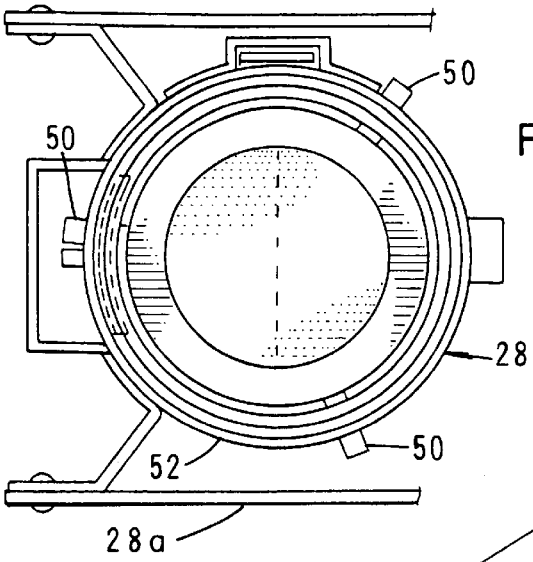
FIG. 6
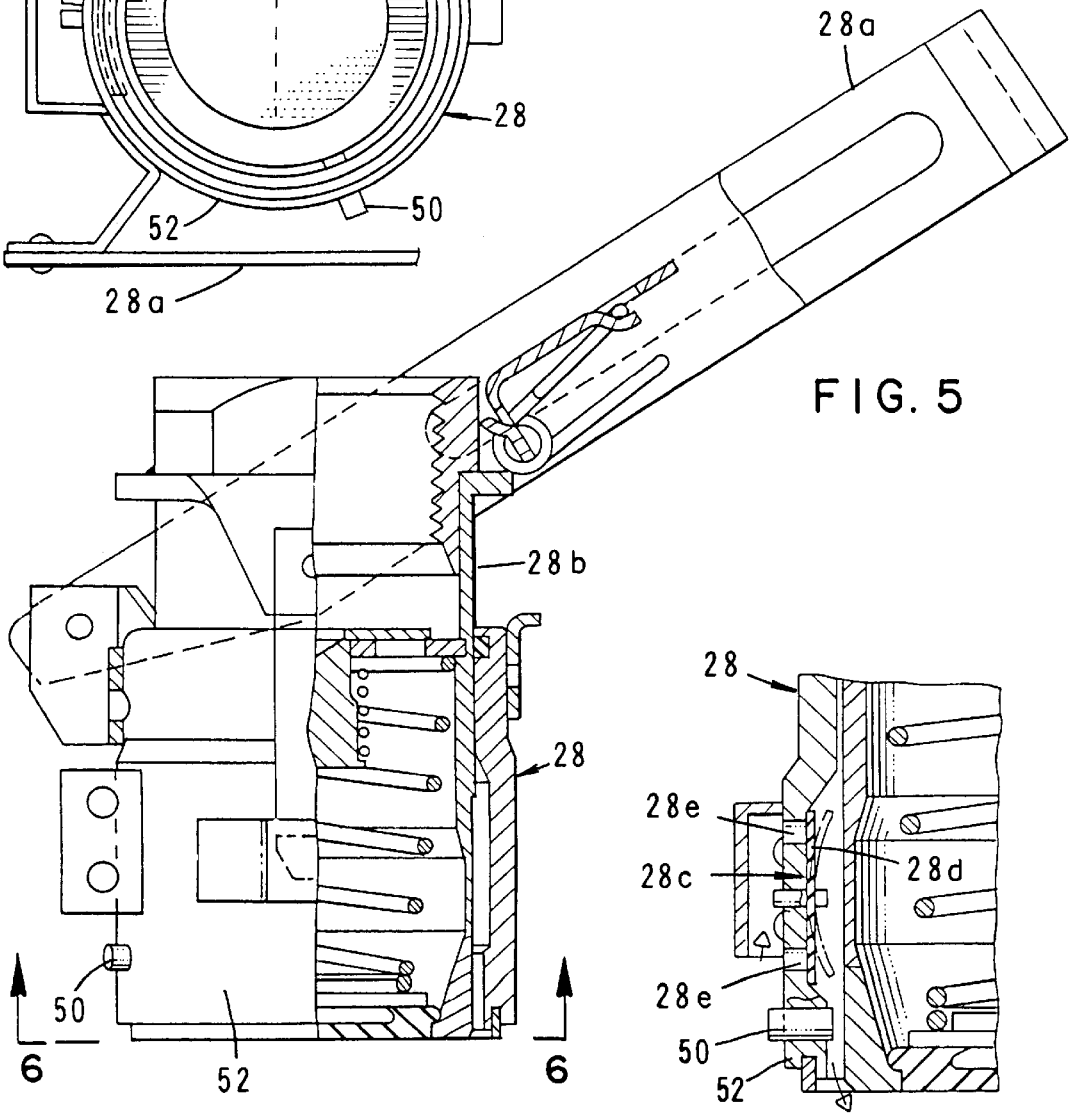
FIG. 5
FIG. 5A

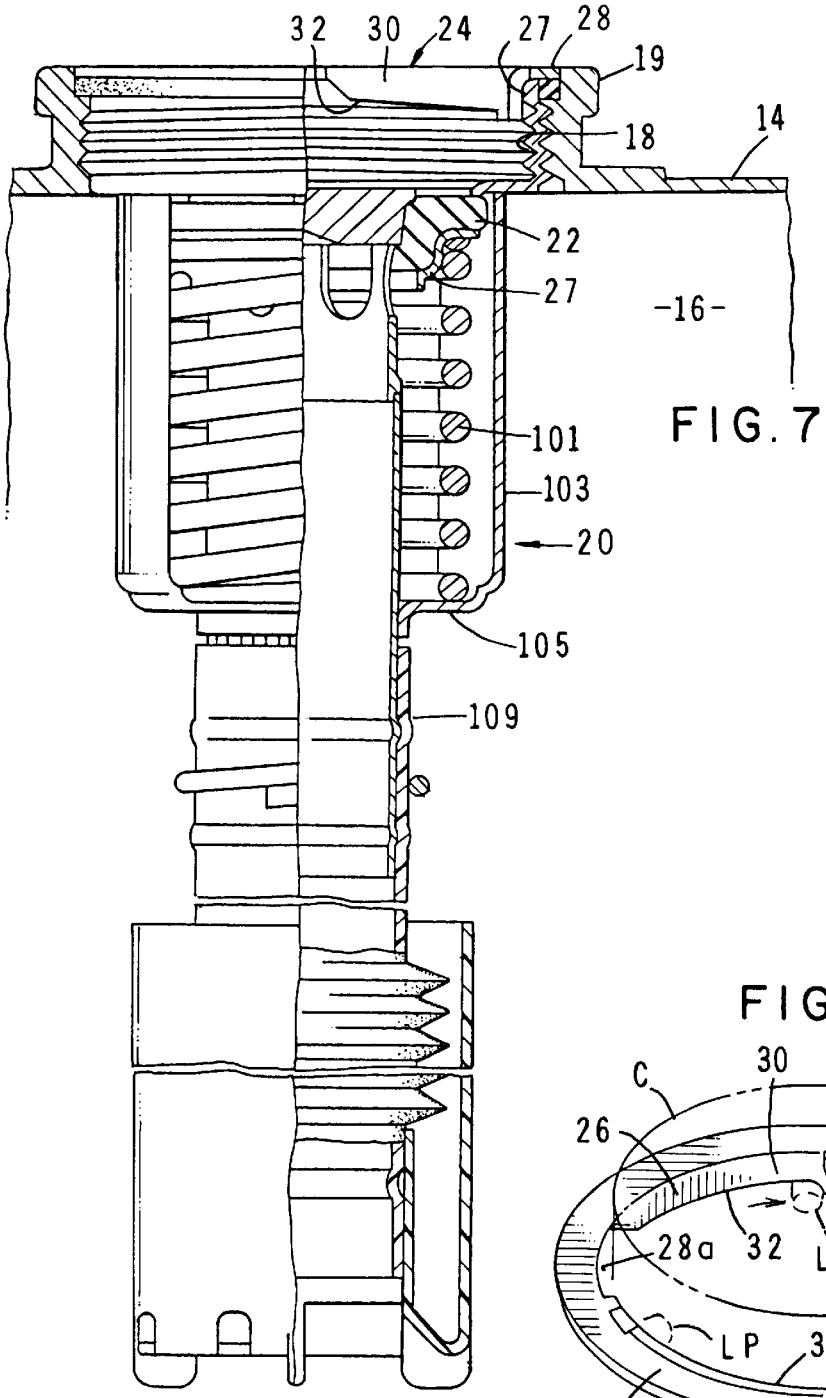
FIG. 7
FIG. 8
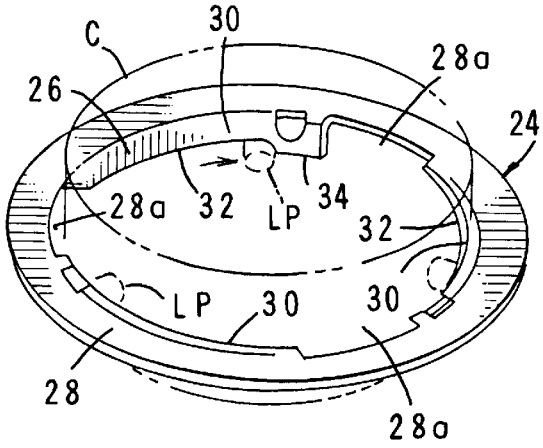

(3 CAM LF TURN)

4 CAM RT TURN

4 CAM LF TURN

4 PIN

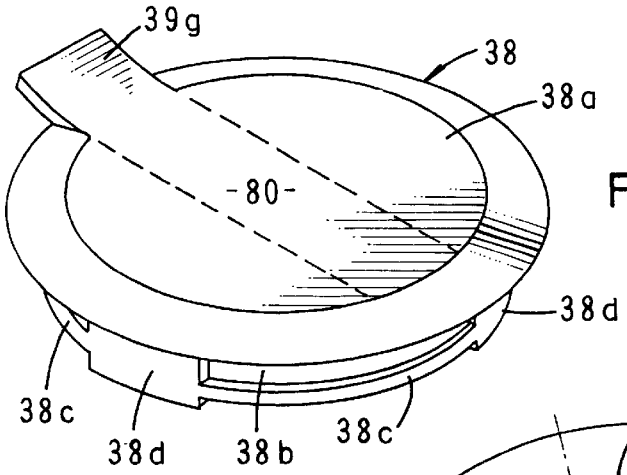
FIG. 13
FIG. 14
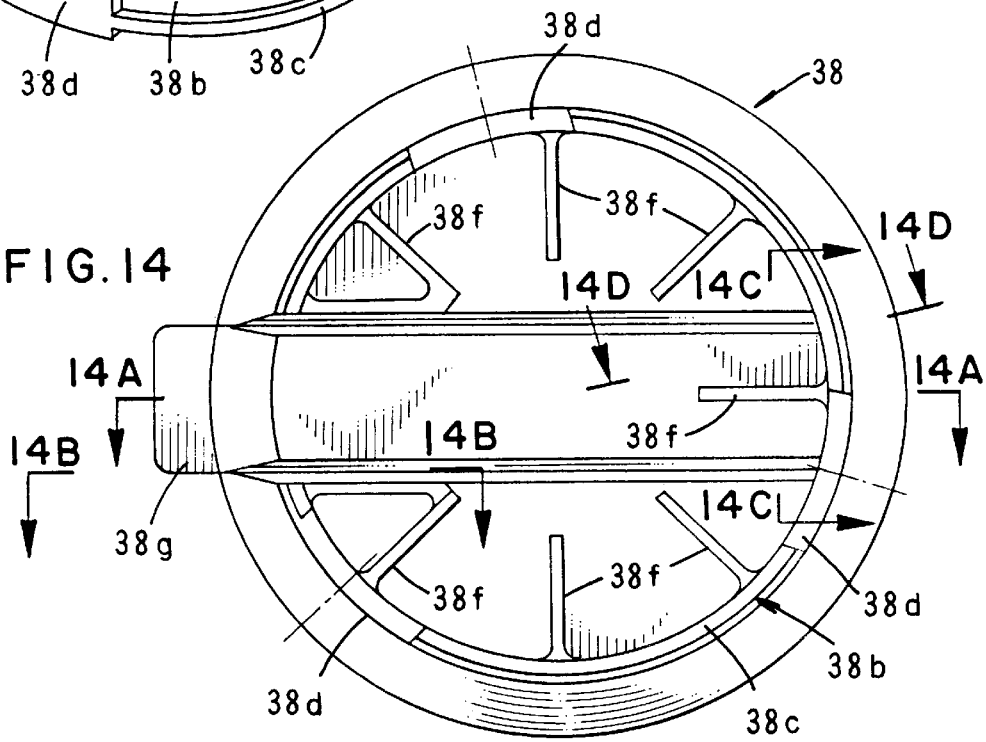
FIG. 14A
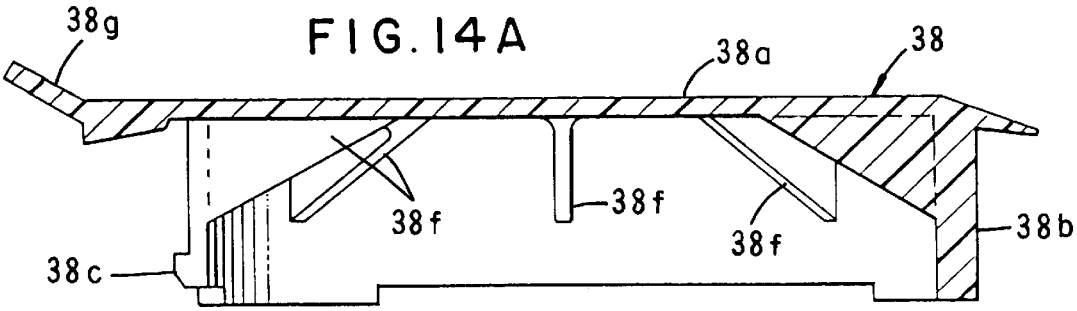

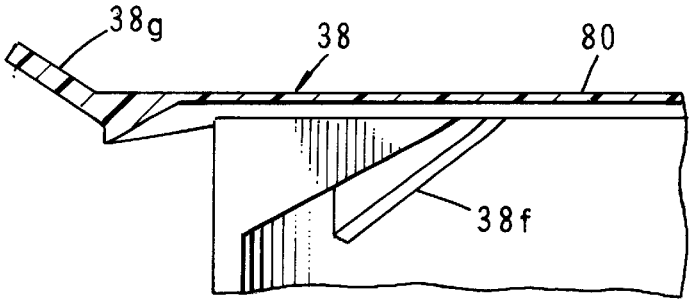
FIG. 14B
FIG. 14C
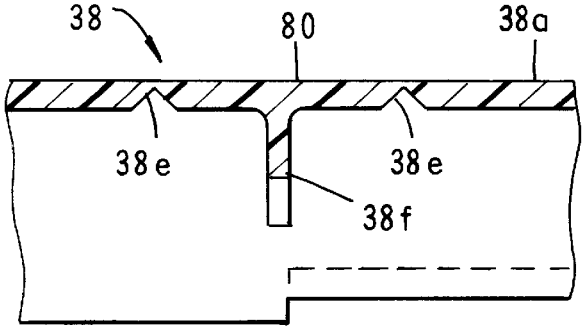
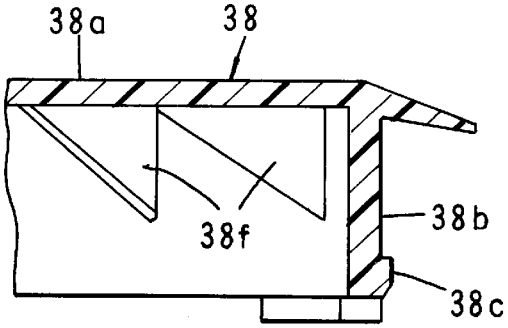
FIG. 14D
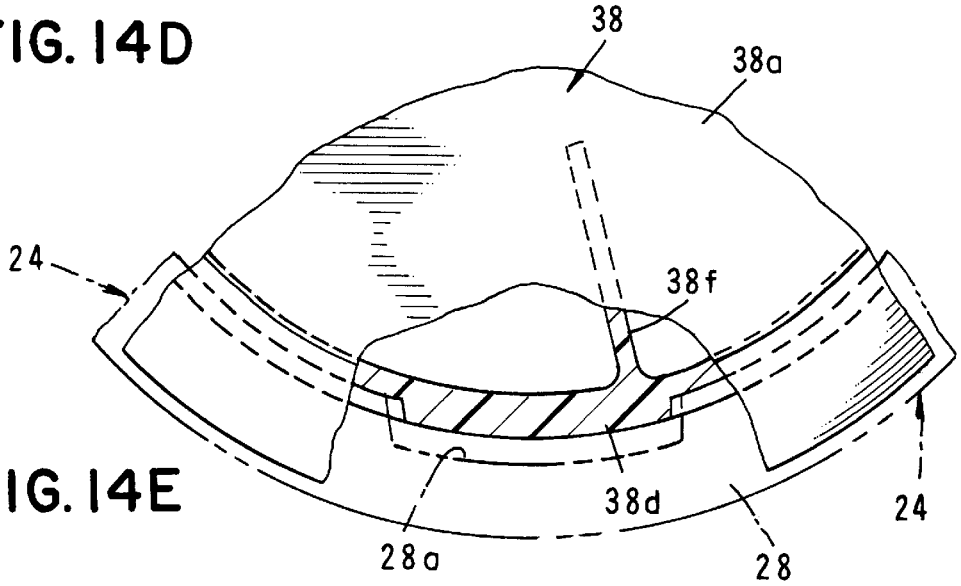
FIG. 14E

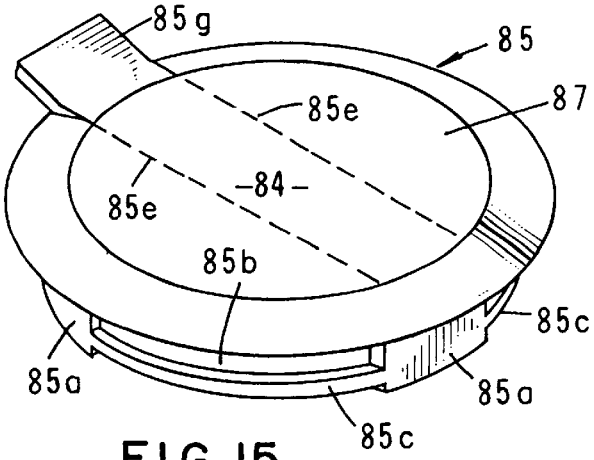
FIG. 15
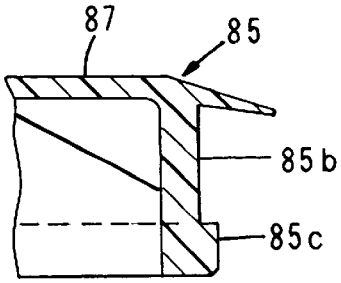
FIG. 16B
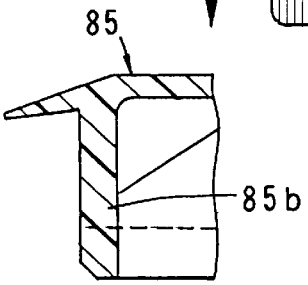
FIG. 16C
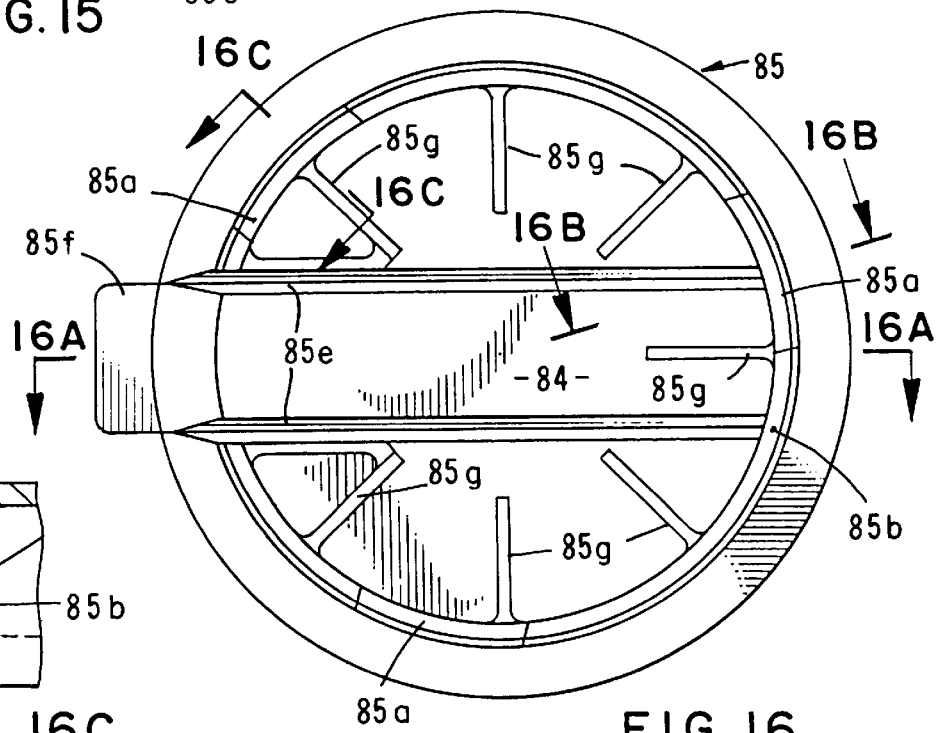
FIG. 16
FIG. 16A
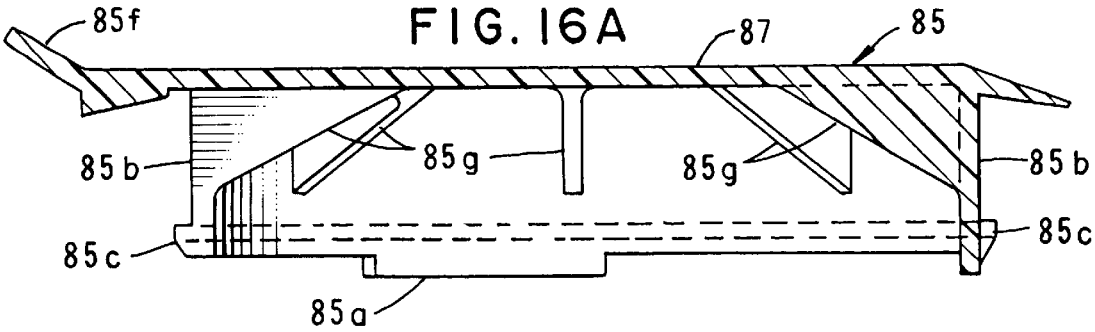

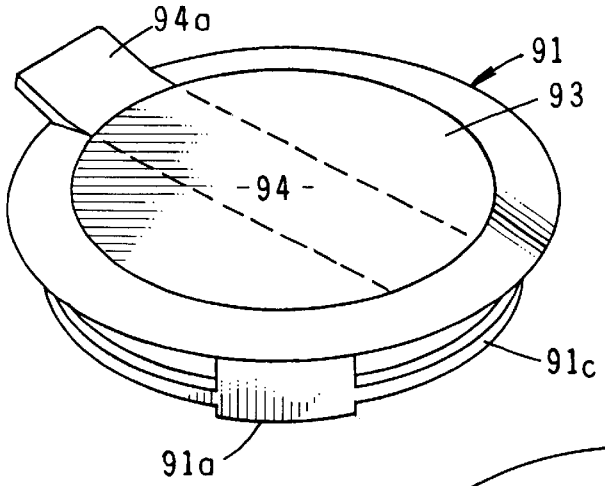
FIG. 17
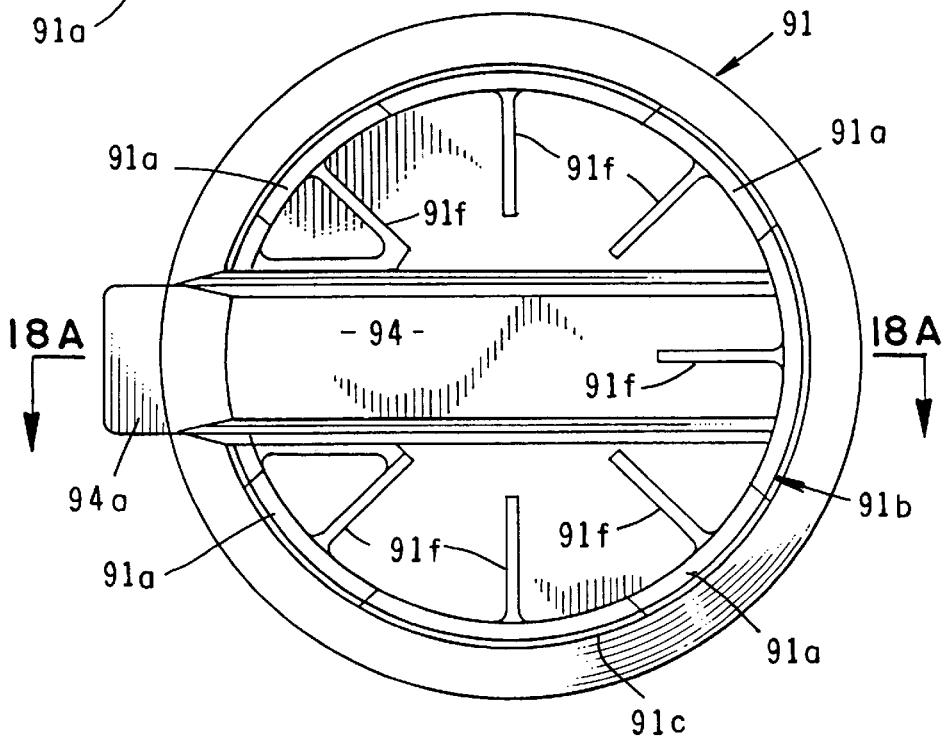
FIG. 18A
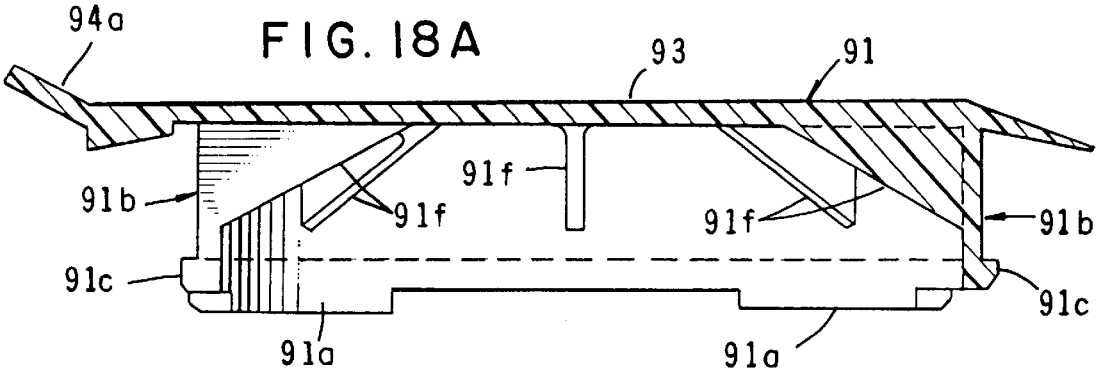

DRUM VALVE SYSTEM WITH TAMPER EVIDENT CAP

BACKGROUND OF THE INVENTION

1. Field of the Invention

The present invention relates generally to systems for the filling, transport, and emptying of liquid containers. More particularly, the invention concerns a novel, tamper-proof, safety valve system that includes a tamper evident valve closure cap that must be broken before liquid can be removed from the container.

2. Discussion of the Prior Art

For many years numerous types of liquids were stored and transported in throw-away type metal and plastic containers. Typically, such containers were provided with a threaded liquid outlet port which after the container was filled, was closed by some type of threaded cap. The use of these types of containers was costly, inefficient and often hazardous, particularly when the containers were used to store and transport potentially dangerous chemicals.

In recent years substantial efforts have been made to develop new systems to improve container and drum management capabilities, minimize user exposure to hazardous materials and address emerging governmental regulations. These efforts have resulted in the development of several different types of reusable systems for transferring liquid formulations from returnable closed drums and containers and for providing means for guarding against potentially dangerous system tampering. As a general rule, these systems to a greater, or lessor extent, simplify drum emptying, minimize operator hazards, improve cleanliness and eliminate costly waste inherent in prior art disposable container systems. One of the most advanced of such improved systems was developed by and is presently commercially available from Micro Matic, Inc. of Northridge, Calif.

The Micro Matic system is basically a two-part system which comprises a coupler operated extractor valve which is interconnectably with a conventional drum via existing threaded connections and a cooperating coupler which connects to the extractor valve to allow drum emptying through the use of a separate pumping system. The extractor valve apparatus which can either remain with the drum after emptying, or can be removed for drum processing, includes a valve body and a down tube connected to the valve body which extends to the bottom of the drum to permit the complete transfer of liquid from the drum. To guard against tampering, the Micro Matic system includes tear-away type closure cap which covers the access port of the valve body when the coupler is separated from the system.

The Micro Matic system, while representing the best of the current state of the art liquid transfer systems, has certain drawbacks which are sought to be overcome by the system of the present invention. By way of example, unlike the prior art Micro Matic system, the novel system of the present invention provides for the first time, a customer unique, key type coupler mating interface and includes a safety closure cap which, unlike the tear away type closure cap of the prior system, can be completely removed from valve body in one simple step. Other improvements and advantages of the present system over the present art systems will be described in greater detail in the paragraphs which follow.

SUMMARY OF THE INVENTION

It is a object of the present invention to provide a novel liquid transfer system which minimizes user exposure to hazardous materials, effectively addresses new governmental regulations and provides a positive means for deterring system tampering.

Another object of the invention is to provide a system of the aforementioned character which improves container and drum management while at the same time significantly reducing the material and labor costs inherent in the use of the prior art liquid transfer systems.

Another object of the invention is to provide a liquid transfer system which includes a novel valve mechanism which can be connected to a container such as a metal or plastic drum, and a coupler mechanism which can be removably coupled with the valve mechanism for operating the valve mechanism. An important aspect of the liquid transfer system is a tamper evident closure cap for closing the top to the dispensing valve mechanism of the system which is of a character such that it must be broken before access to the container can be achieved.

Another object of the invention is to provide a tamper evident closure cap which is of a simple design and one which can be easily and completely removed from the valve mechanism with minimum effort.

Another object of the invention is to provide a tamper evident closure cap of the character described in the preceding paragraphs which after being removed is functionally disabled and which cannot be re-used.

Another important object of the present invention is to provide a liquid transfer system of the character described in which the top opening of the valve mechanism is uniquely configured so that it will accept only couplers of a particular compatible design. In this way, couplers and valves can be custom designed for individual users and use of or tampering with containers belonging to the individual user by users of similar systems is positively prevented.

Another object of the invention is to provide a liquid transfer system as described in the preceding paragraph in which the tamper evident cap of the system is uniquely configured so that it can be used only with couplers of a particular, compatible configuration.

Another object of the invention is to provide a fluid transfer system of the aforementioned character which is highly reliable and is easy to use with a minimum amount of instruction being required.

BRIEF DESCRIPTION OF THE DRAWINGS

FIG. 5 is a side elevational view, partly in cross-section, of one form of the transfer coupler mechanism of the liquid transfer system of the present invention.

FIG. 5*a* is a fragmentary, cross-sectional view of the venting valve mechanism of the coupler shown in FIG. 5.

FIG. 6 is a view taken along line 6—6 of FIG. 5.

FIG. 7 is a side elevational view, partly in cross-section, of one form of the valving mechanism of the liquid transfer system of the present invention.

FIG. 8 is a generally perspective view of one form of a three-cam, right-turn cam ring component which forms a part of the valving mechanism shown in FIG. 7.

FIG. 13 is a generally perspective view of one form of the tamper proof cap of the present invention.

FIG. 14 is an enlarged bottom plan view of the tamper proof cap shown in FIG. 13.

FIG. 14A is a cross-sectional view taken along lines 14A—14A of FIG. 14.

FIG. 14B is a cross-sectional view taken along lines 14B—14B of FIG. 14.

FIG. 14C is a cross-sectional view taken along lines 14C—14C of FIG. 14.

FIG. 14D is a cross-sectional view taken along lines 14D—14D of FIG. 14.

FIG. 14E is a fragmentary view of a portion of the tamper evident cap shown in FIG. 13, partly broken apart to illustrate the manner in which the tamper evident cap mates with one of the cam ring components of the invention.

FIG. 15 is a generally perspective view of an alternate form of tamper evident cap of the present invention.

FIG. 16 is an enlarged bottom plan view of the tamper evident cap shown in FIG. 15.

FIG. 16A is an enlarged cross-sectional view taken along lines 16A—16A of FIG. 16.

FIG. 16B is an enlarged fragmentary view taken along lines 16B—16B of FIG. 16.

FIG. 16C is a cross-sectional view taken along lines 16C—16C of FIG. 16.

FIG. 17 is a generally perspective view of still another form of tamper evident cap of the present invention.

FIG. 18 is an enlarged bottom plan view of the tamper evident cap shown in FIG. 17.

FIG. 18A is a cross-sectional view taken along lines 18A—18A of FIG. 18.

DESCRIPTION OF THE INVENTION

Figure 1:
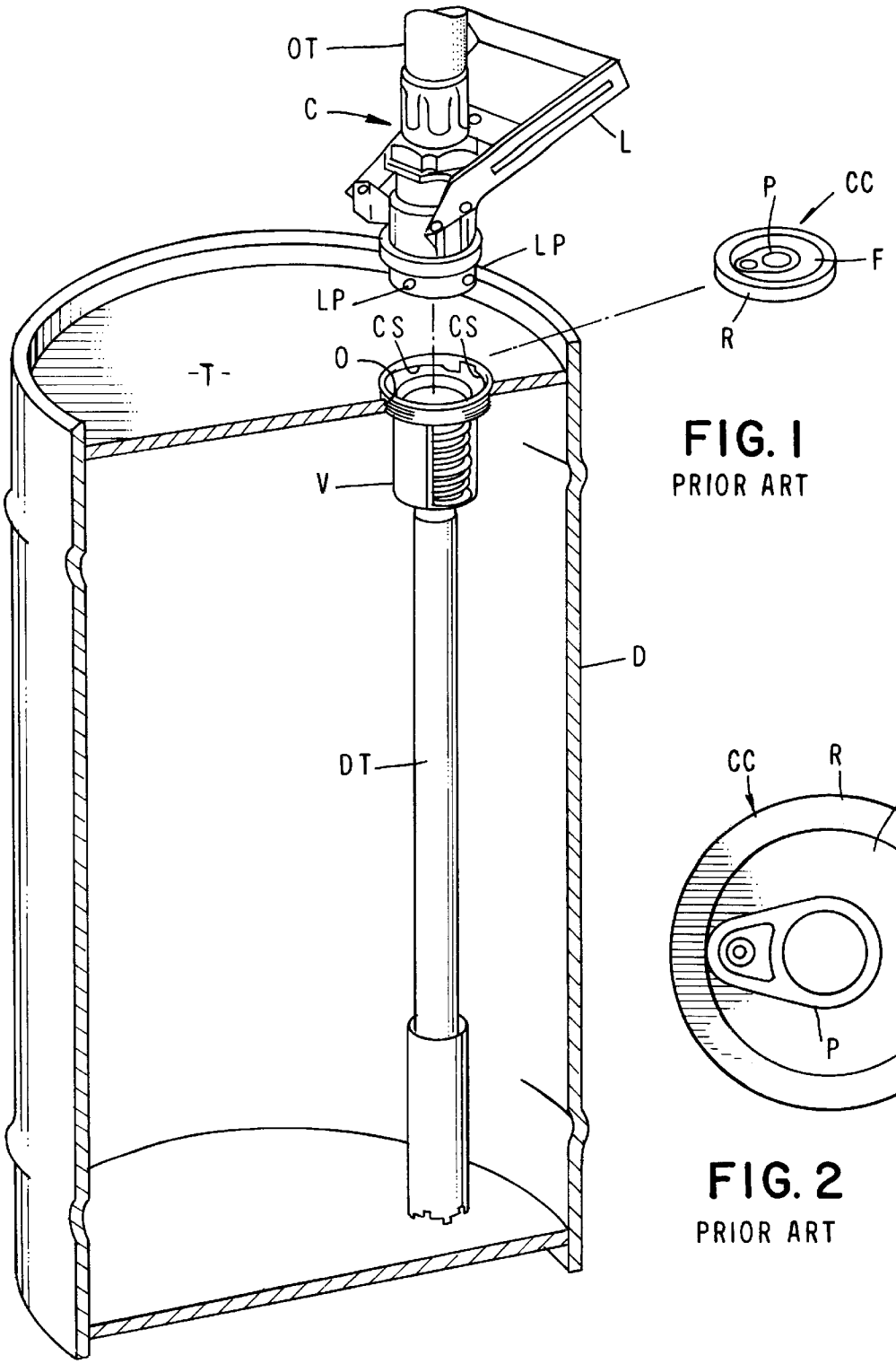
FIG. 1 PRIOR ART
FIG. 1 is a generally perspective exploded view of a prior art liquid transfer system showing the fluid container drum broken away to reveal internal construction of the prior art valving mechanism.

Referring to the drawings and particularly to FIGS. 1 through 4, a prior art fluid transfer system of the character manufactured and sold by Micro Matic U.S.A., Inc. of Northridge, Calif. is there illustrated. This liquid transfer system comprises a fluid container or drum "D" of a conventional type having a threaded opening "O" provided in the top wall "T" of the container. In FIG. 1, the Micro Matic coupler operated extractor valve assembly "V" is shown threadably interconnected with drum "D" with the valve body thereof extending through opening "O". As indicated in FIG. 1, the extractor valve apparatus "V" includes a down tube "DT" which is connected to the valve body and extends downwardly to a location proximate the bottom of the drum to permit the complete extraction of liquids therefrom.

Figure 2:
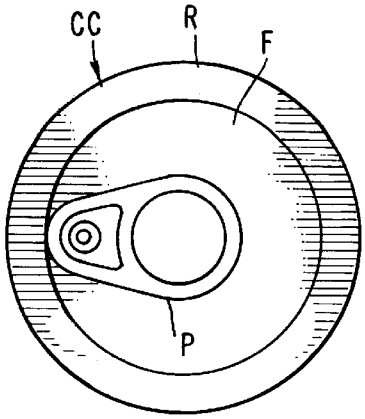
FIG. 2 PRIOR ART
FIG. 2 is a top plan view of the closure cap used in the prior art system of FIG. 1.

When the coupler mechanism "C" of the Micro Matic system is not coupled with the valve mechanism "V", the top opening of the valve mechanism is sealably closed by closure cap "CC" of the character illustrated in FIGS. 1 and 2. Closure cap "CC" has a circumferentially extending rim portion "R" which is fitted over the upper edge peripheral of the valve mechanism and a central frangible portion "F" which is of a tear-away type that can be separated from the rim portion "R" by exerting an upward force on the pull tab or pull ring assembly "T" which is provided on the central portion "F" of the closure cap. (FIG. 2). disadvantageously, when a force is exerted on the pull ring to effect removal of the frangible portion "F", the circumferencially extending rim portion "R" of the closure cap remains securely affixed to the upper rim portion of the valve assembly "V" and must be removed by a troublesome cutting operation before another tamper proof closure cap can be interconnected with the valve mechanism "V".

Figure 3:
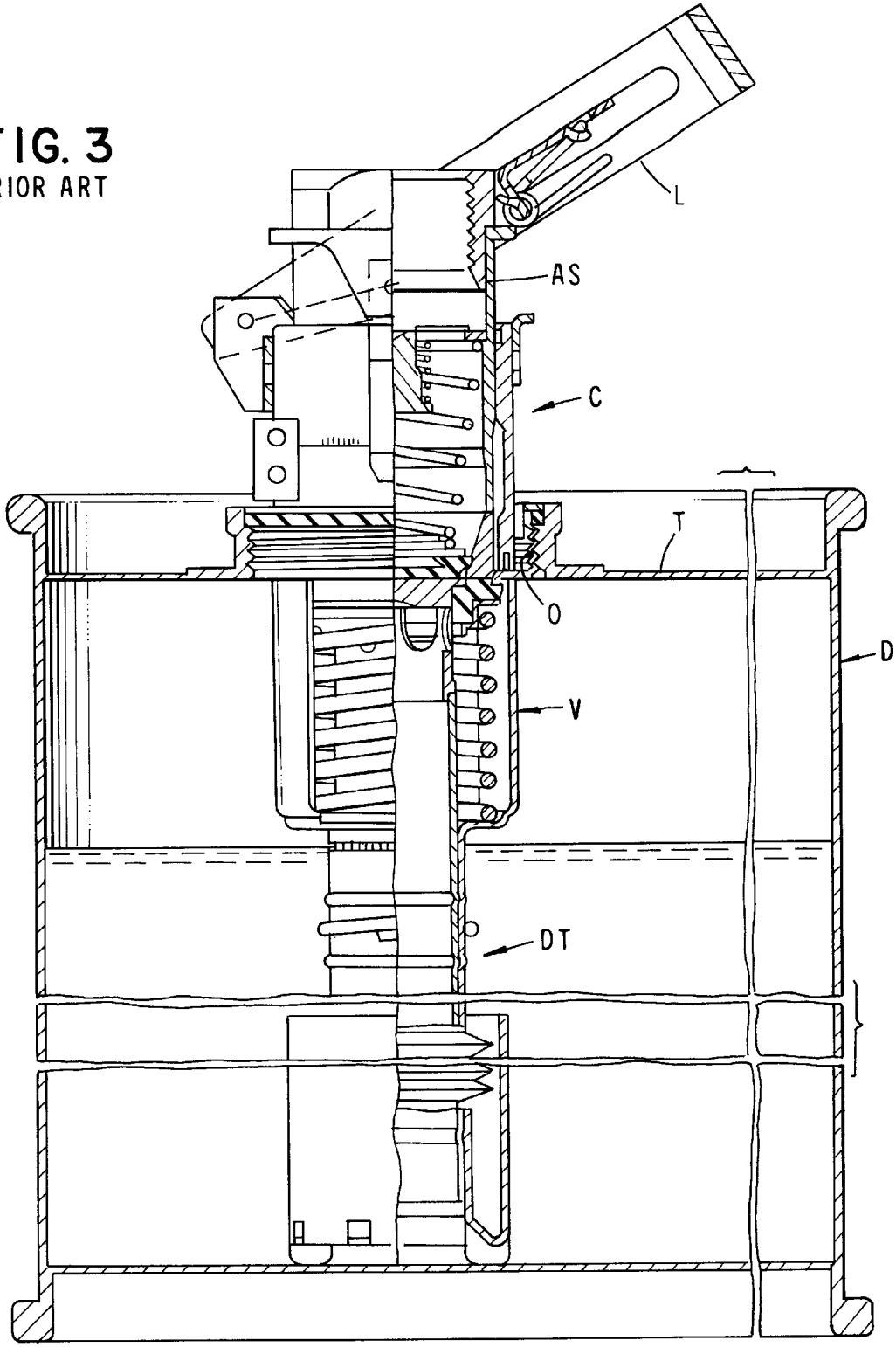
FIG. 3 PRIOR ART
FIG. 3 is a foreshortened side-elevational, cross-sectional view of the prior art liquid transfer system shown in FIG. 1 with the liquid transfer coupler interconnected with the valve system which is in turn, internally interconnected with the liquid container.
Figure 4:
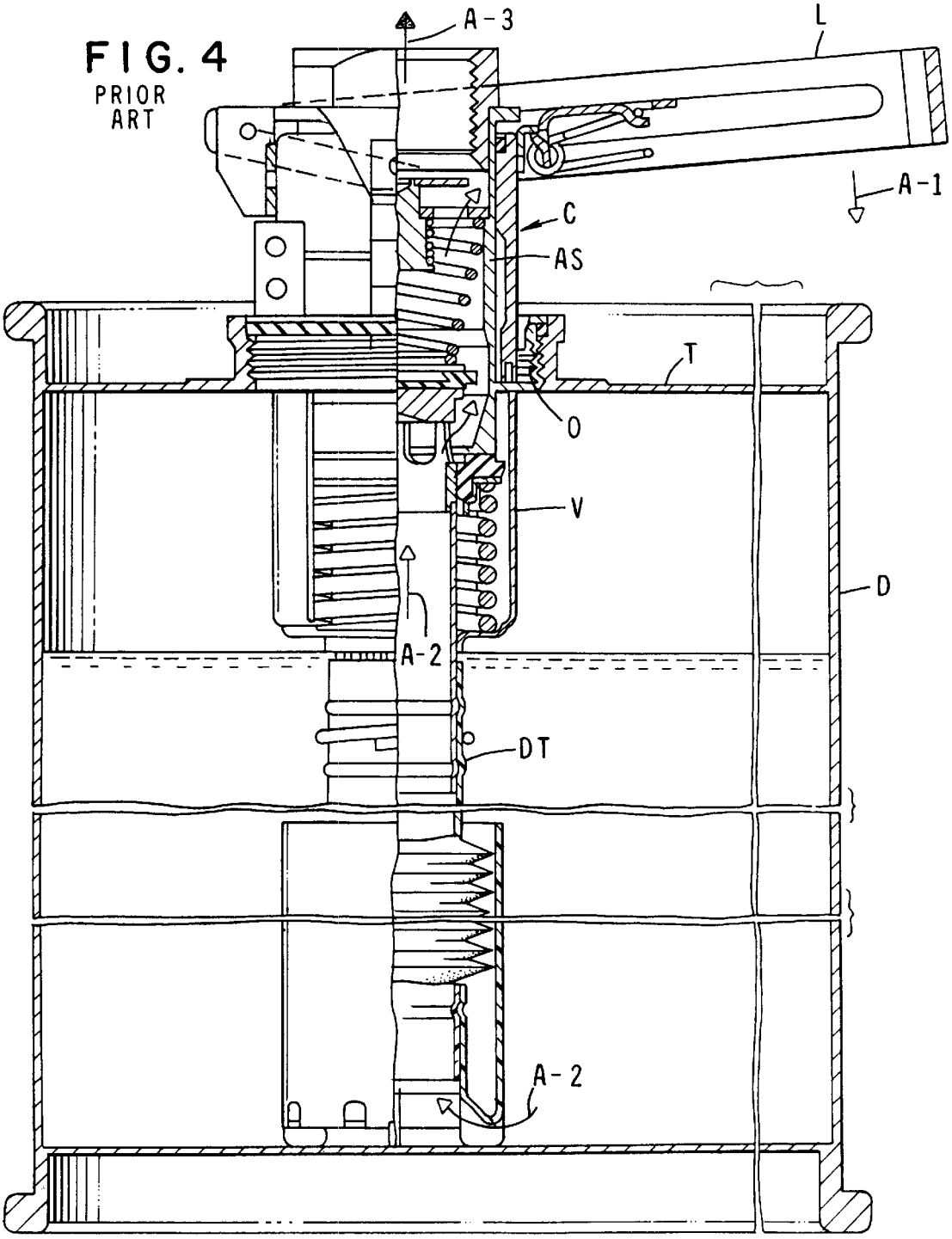
FIG. 4 PRIOR ART
FIG. 4 is a side elevational cross-sectional view of the prior art device shown in FIG. 3 but shown in the configuration wherein the transfer coupler is in a valve actuating configuration to permit liquid flow from container through the valve into the coupling mechanism and outwardly into the liquid transfer line.

Referring to FIGS. 3 and 4, it can be seen that, in the prior art Micro Matic liquid transfer system, the coupler assembly "C" is removably interconnected with the valve assembly "V" by means of a bayonet-like coupling system. More particularly, as shown in FIG. 1, the opening, or connector port of the Micro Matic valve body is provided with a plurality of circumferentially spaced, machined or otherwise integrally formed, cam surfaces "CS" (FIG. 1) which are mateably engaged by a plurality of outwardly extending circumferentially spaced locking pins "LP" provided proximate the lower, cylindrically shaped portion of the coupler assembly "C".

In operation of the Micro Matic system, the coupler assembly "C" is interconnected with the valve mechanism by inserting the lower portion of the coupler mechanism into the connector port of the valve assembly then rotating the coupler so that the locking pins "LP" ride upwardly along the cam surfaces "CS" in a manner to urge the coupler into sealable interconnection with the valve mechanism (FIG. 3). When the coupler is interconnected with the valve mechanism in the manner shown in FIG. 3, a liquid type seal is formed between the coupler mechanism "C"0 and the connector port of the valve body of the valve assembly "V". This type of coupler extractor valve interface is of a character well known to those skilled in the art and is fully described in technical publications available from Micro Matic U.S.A., Inc. of Northridge, Calif.

After the coupler assembly "C" of the Micro Matic system has been interconnected with the valve assembly "V" in the manner described in the preceding paragraphs, a downward pressure exerted on the operating lever "L" of the coupler mechanism in the direction of the arrow A-1 if FIG. 4 will cause the actuating sleeve "AS" of the coupler mechanism to move downwardly in a manner to open the normally closed valve thereby permitted fluid to flow from drum "D" through the down tube "DT" in the direction of the arrows A-2 of FIG. 4 and then outwardly of the coupler in the direction of the arrow A-3 toward an outlet tube "OT" (FIG. 1) which is appropriately interconnected with an externally located pumping system. Once again, the operation of the coupler mechanism and pumping system of the Micro Matic liquid transfer apparatus is well known to those skilled in the art and is fully described in Micro Matic U.S.A., Inc. technical publications.

Turning now to FIGS. 5 through 7 wherein the operating components of the liquid transfer system of the present invention are illustrated, it is to be noted that the improved system is of somewhat similar design to the prior art Micro Matic U.S.A., Inc. system illustrated in FIGS. 1 through 4 and operates in a generally similar manner. More particularly, the improved liquid transfer system of the present invention comprises a container 14 of the character generally illustrated in FIG. 1 having an internal compartment 16 for containing the liquid to be dispensed (FIG. 7). Container 14 includes a threaded access opening 18 provided in an upstanding collar or internally threaded neck 19 for permitting access to internal compartment 16. An extractor valve assembly 20 is threadably interconnected with access opening 18 in the manner shown in FIG. 7 and includes an elastomeric valve member 22 which is movable by a coupler assembly from a closed position shown in FIG. 7 to an open position wherein fluid is permitted to flow through the valve assembly 20 and outwardly of container 14. As will be discussed in greater detail hereinafter, the coupler assembly of the invention is interconnected with and operates the extractor valve assembly in much the same manner as does the prior art Micro Matic coupler.

Forming an extremely important aspect of the apparatus of the present invention is the provision of a novel connector ring 24 which is interconnected with the extractor valve mechanism of the apparatus. The connector ring, which comprises one of the principal differences between the Micro Matic system and the apparatus of the present invention, takes the place of the integrally form cam surface "CS" of the prior art valve assembly "V" which is of the character shown in FIG. 1. Cam ring 24 of the invention, which is of the unique configuration shown in FIG. 8, and can be affixed to the upper portion, or outlet port, of the valve assembly of the invention. More particularly, unlike the opening provided in the Micro Matic valve assembly, the valve assembly is here machined or otherwise formed to provide a smooth, generally cylindrically shaped upper outlet opening within which the cam ring is closely received. In the manner shown in FIG. 7, the cam ring is affixed to the valve assembly by any suitable means such as welding to form an access opening 27 for receipt of the coupler assembly 28 of the invention which is of the character shown in FIG. 5. Coupler assembly 28 is of the same general construction as the Micro Matic coupler assembly "C" and operates in much the same manner. However, as will become more clear from the discussion that follows, coupler assembly 28 is specifically configured to interface with the novel cam rings of the invention, which, as will presently be described, can be of several alternate configurations.

Figure 19:
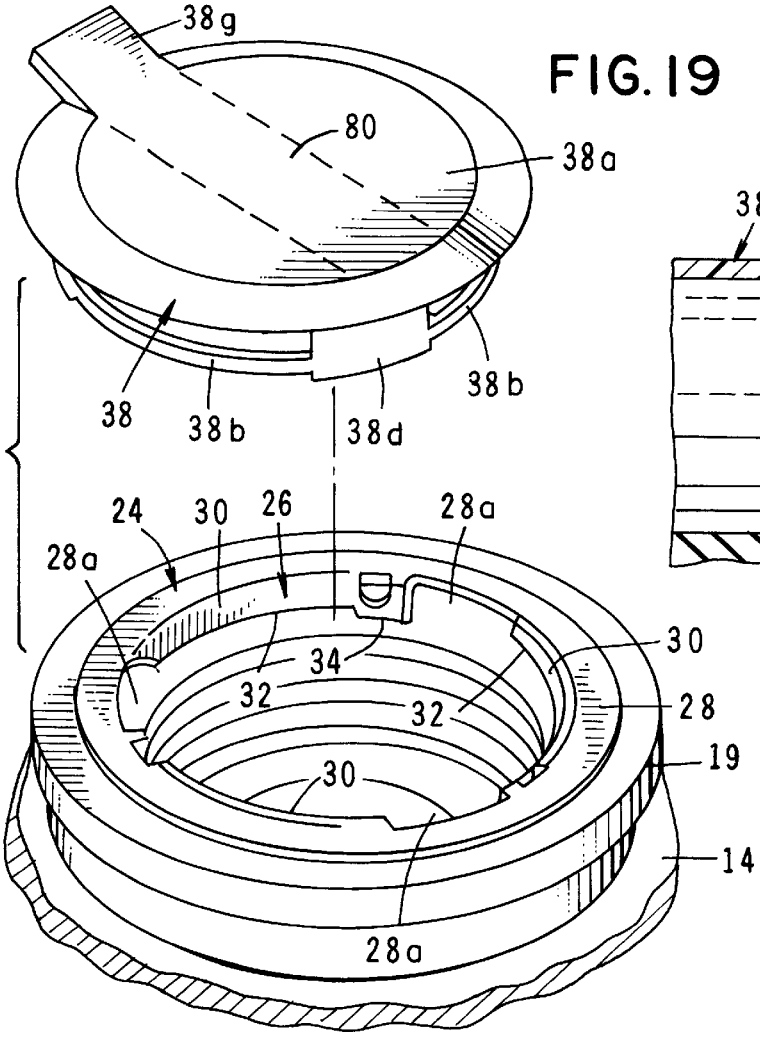
FIG. 19 is a generally perspective exploded view illustrating the manner in which the tamper evident cap shown in FIG. 13 is mated with a valve mechanism having a three-cam type cam-ring component of the character shown in FIG. 9 interconnected therewith.
Figure 20:
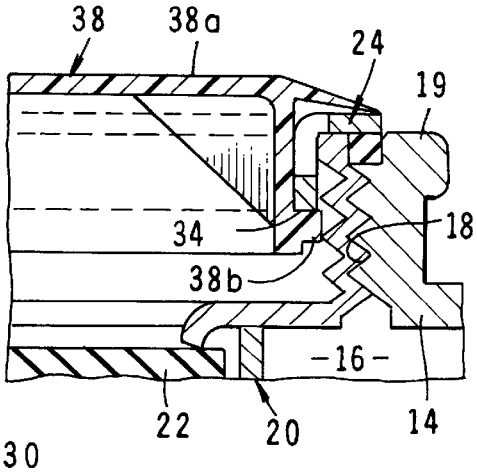
FIG. 20 is a cross-sectional view taken along lines 20—20 of FIG. 19A.
Figure 19A:
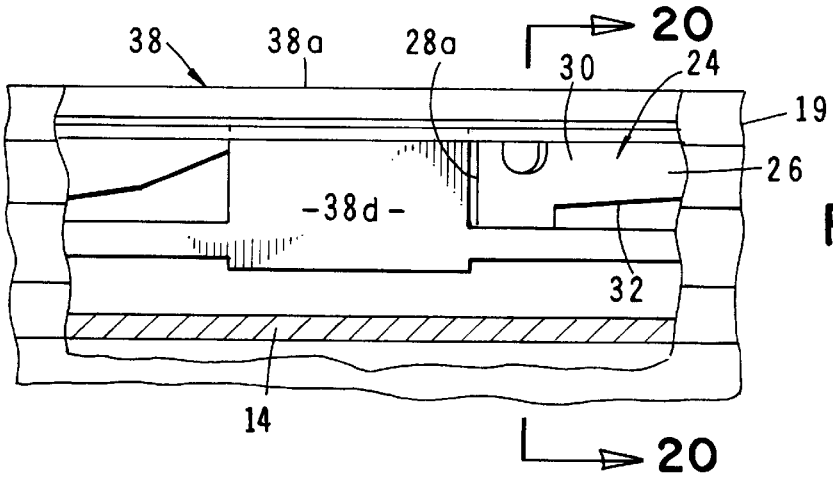
FIG. 19A is an enlarged, fragmentary, side-elevational view showing the tamper evident cap mated with the valve mechanism.

One form of the novel connector ring of the present invention is shown in FIGS. 7 and 8 and can be seen to include a skirt-like portion 26, which terminates in an upper peripherally extending, generally circular shaped flange 28. Formed on skirt portion 26 are a plurality of circumferentially spaced, cam-defining walls or segments 30 (FIG. 8). Each of the cam-defining segments 30 includes a lower caming surface 32 and a capture surface 34 (see also FIGS. 19 and 20). In a manner presently to be described, capture surface 34 functions to capture the novel tamper evident cap assembly 38 of the present invention and prevent its removal from the extration valve assembly. One form of this highly novel tamper evident cap is shown in FIGS. 19 and 20.

Figure 9:
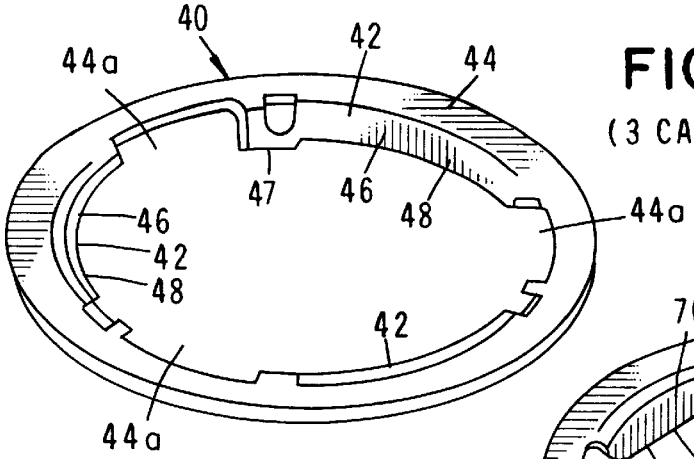
FIG. 9 is a generally perspective view of an alternate form of three-cam, left-turn cam ring component which forms a part of an alternate form of the valving mechanism of the invention.

Turning to FIG. 9, an alternate form of the connector ring of the present invention is there illustrated and generally identified by the numeral 40. Cam ring 40 is of similar construction to cam ring 24 and includes a skirt-like portion 42 which terminates in a peripherally extending, upper flange portion 44. As before, a plurality of circumferentially spaced cam-defining segments 46 comprise a part of portion 42 with each segment 46 having a sloping caming surface 48. Cam ring 40 is of the same basic configuration as cam ring 24 in that both rings include three circumferencially spaced apart cam segments 46 and three circumferentially spaced capture surfaces 47.

To enable operable interconnection of the coupler assembly 28 of the present invention with the extractor valve assembly 20 a plurality of spaced-apart locking pins 50 are provided on the lower body portion of the coupler assembly. As shown in FIGS. 5 and 6, locking pins 50 are connected to and extend outwardly from the lower, cylindrical surface 52 and are constructed and arranged to engage and ride along caming surface 48 upon rotation of the coupler assembly relative to the connector ring.

When the connector ring takes the configuration shown in FIG. 8, the coupler is rotated in a clockwise, or right-turn direction, in order to sealably interconnect the coupler assembly with the extractor valve assembly. However, with the configuration of the connector ring 40 as shown in FIG. 9, the sealable interconnection of the coupler assembly with the extractor valve assembly is accomplished by rotating the coupler assembly in an opposite, or counterclockwise, left-turn direction relative to the coupler ring. As previously mentioned, cam surfaces 32 and 48 of the cam rings function in generally the same manner as the integrally formed cam surfaces "CS" of the Micro Matic valve assembly "V". However, in the prior art Micro Matic valve assembly, the integrally formed cam surfaces "CS" can accept only the particularly configured coupler assembly for rotation only in particular direction. In the apparatus of the present invention, however, the extractor valve assembly and the coupler assembly can be specially tailored to enable a selective coupler rotation either in a clockwise or counterclockwise rotation. This is accomplished by choosing a particular connector ring such as connector ring 24, for interconnection with the valve assembly. Alternatively, an alternate connector ring such as connector ring 40 can be selected. With this novel arrangement, couplers and valves can be custom designed for individual users and use of, or tampering with containers belonging to the individual users by users of similar systems is positively prevented.

Figure 10:
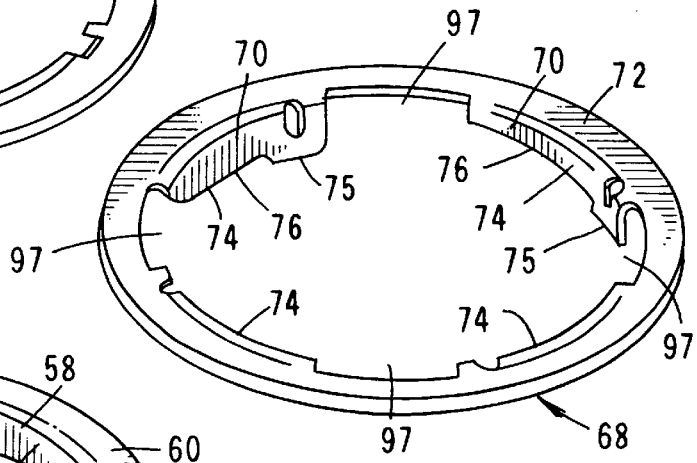
FIG. 10 is another form of the cam ring component of the invention shown here as a four-cam, right-turn cam ring.

Turning to FIG. 10, still another form of cam ring of the invention is there illustrated and generally identified by the numeral 56. Cam ring 56 is of similar configuration to rings 24 and 40 and includes a skirt portion 58 which terminates in a peripheral flange 60. However, unlike the cam rings shown in FIGS. 8 and 9, cam ring 56 is provided with four circumferentially spaced cam-defining segments 62. Each cam-defining segment 62 includes a caming surface 64 and a capture surface 66.

Figure 11:
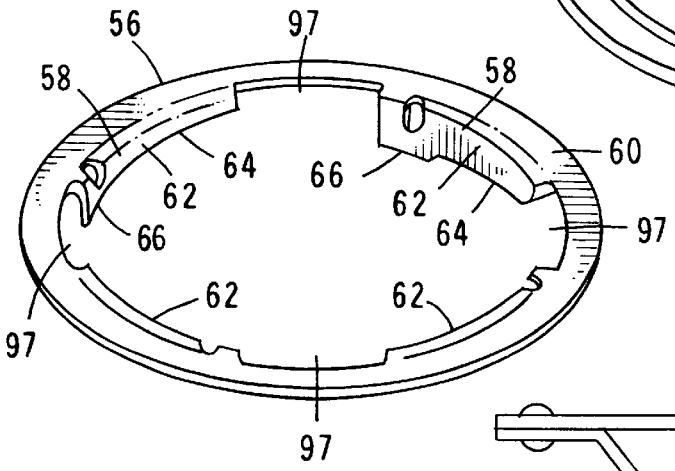
FIG. 11 is still another alternate form of four-cam, left-turn cam ring component of the apparatus of the invention.

A similar, alternate form of cam ring is shown in FIG. 11 and identified by the numeral 68. Ring 68 also includes a skirt-like portion 70 which terminates in a peripheral flange 72. Like ring 56, cam ring 68 also includes four circumferentially spaced cam-defining walls 74. Each of these cam walls 74 includes a capture surface 75 and a caming surface 76, which functions to be slidably engaged by strategically configured locking pins provided on the mating coupler assembly.

A comparison of cam ring 56 with cam ring 68 shows that cam ring 56 is of a right-turn configuration, that is, of a configuration which will accept a specially configured coupler such as coupler 70 (FIG. 12) which has four circumferentially spaced locking pins 73. When coupler assembly 70 is turned in a clock wise direction, the coupler assembly will be moved into sealable interconnection with the valve mechanism. Cam ring 68, on the other hand, is specially configured to also accept coupler assembly 70. However, with this cam ring construction, the coupler assembly must be rotated in a counterclockwise or left-turn direction in order to interconnect the coupler assembly with the valve assembly.

It is apparent that the use of cam rings 56 and 68 provide still further opportunities for customizing the valve and coupler assemblies of a particular user and for rendering their systems unusable by owners of couplers of a configuration designed to cooperate with cam rings of the character shown in FIGS. 8 and 9, namely three-cam left-turn and three-cam right-turn cam rings.

Also forming an extremely important feature of the liquid dispensing means of the present invention is the uniquely constructed, previously mentioned, tamper-evident cap 38. In the manner shown in FIGS. 19 and 20, tamper-evident cap 38 is connected to the appropriate connector or cam ring to temporarily close the access opening in the valve extraction assembly of the invention. Tamper-evident cap 38 is provided with a frangible top wall 38*a*, a portion of which is breakable to permit removal of the cap from the access opening of the valve assembly.

Turning particularly to FIGS. 13, 14, 14A, 14B, 14C, 14D, and 14E, one form of the tamper-evident cap of the present invention is there illustrated. As indicated in FIG. 13, top wall 38*a* includes a removable segment, or frangible strip 80, which in a manner presently to be described, can be removed to enable removal of the tamper-evident cap from the valve assembly of the invention. Cap 38 also includes a yieldably deformable skirt portion 38*b* which is connected to and extends downwardly from top wall 38*a* in the manner best seen in FIG. 14A. Cap 38 also includes locking means for lockably engaging the capture surfaces of a selected connector ring to prevent removal of the cap therefrom until segment 80 has been broken away from the top wall 38*a* to permit skirt portion 38*b* to be deformed inwardly a sufficient distance to allow removal thereof from the coupler receiving opening.

In the embodiment of the invention shown in FIGS. 13 and 14, this important locking means comprises a circumferentially extending flange 38*c* which extends between and is interconnected with three circumferentially spaced wall sections or guide lands, identified in the drawings by the numeral 38*d*.

As best seen by referring to FIG. 14C, top wall 38*a* of cap 38 is provided with a pair of spaced apart striations 38*e* which extend along the marginal portions of removable segment 80. In a manner presently to be described, striations 38*e* permit easy removal of removable section 80 by exerting an upward force on a removal tab 38*g*, which also forms a part of the tamper-evident cap 38. To provide structural integrity to tamper-evident cap 38, a plurality of radially outwardly extending rib-like members 38*f* are connected to the under surface of wall 38*a* (FIGS. 14, 14A, and 14B).

By comparing the tamper evident cap shown in FIG. 13 with the three-cam, right-turn connector ring 24 shown in FIG. 8, it can be seen that cap 38 is adapted to mate with ring 24 so that guide lands 38*b* are guidably received within the cutout relief portions 28*a* provided in flange 28 of ring 24. With this construction, with the tamper-evident cap 38 positioned relative to cam ring 24 in the manner shown in FIG. 19, a downward movement of the cap into mating engagement with ring 24 followed by the exertion of a downward force on the cap will cause portions of locking flange 38*c* to snap under capture surfaces 34 thereby securing cap 38 to ring 24 in a manner to prevent its removal therefrom so long as cap 38 remains intact. More particularly, with this construction, cap 38 cannot be removed from the valve assembly without its taper evident distruction.

Figure 23:
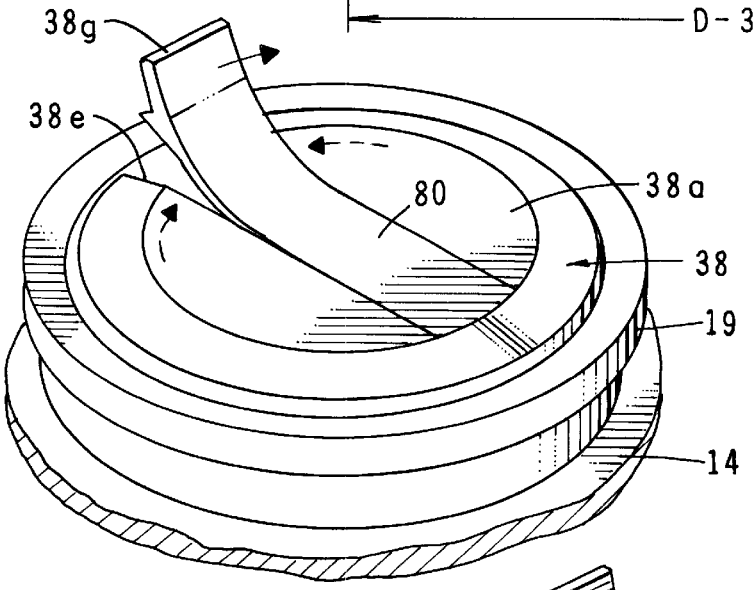
FIG. 23 is a generally perspective fragmentary view illustrating the manner of removal of the tamper evident cap of the present invention from a valve mechanism of the invention.
Figure 23A:
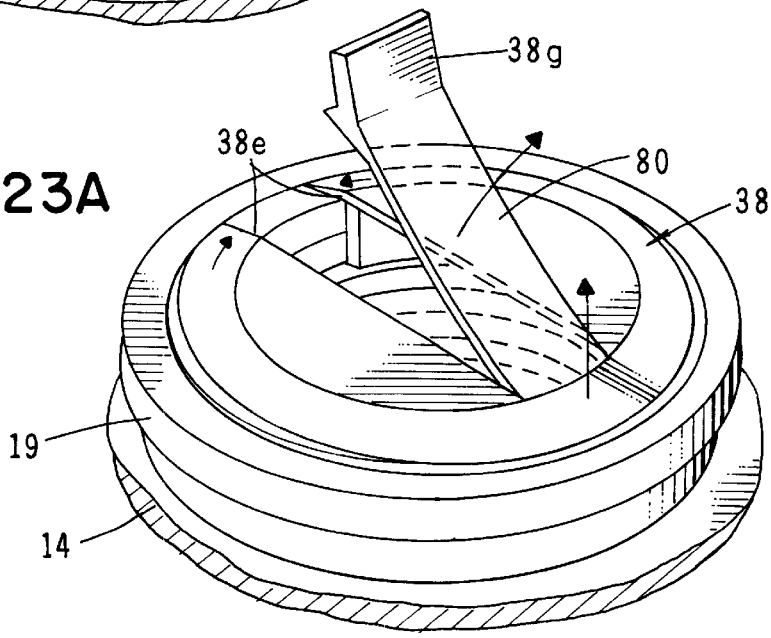
FIG. 23*a* is a fragmentary cross-sectional view similar to FIG. 23 but showing the tear strip of the tamper evident cap removed from the body portion of the cap.

Turning next to FIGS. 23 and 23A, the removal steps for removing tamper-evident cap 38 from valve assembly 20 is there illustrated. As indicated in FIG. 23, by grasping pull-tap 38*g* with the fingers and exerting an upward force thereon, frangible strip 80 will break away from top surface 38*a* along striations 38*e* so that the frangible strip can be readily separated from the cap in the manner illustrated in FIG. 23A. With strip 80 separated from the cap, an inward pressure exerted on the sides of the cap will permit it to be radially deformed inwardly a sufficient amount to allow flange portions 38*c* to clear capture surfaces 34 of the cam ring so as to permit easy removal of the tamper-evident cap from the valve assembly. It is apparent that once frangible strip 80 has been removed from the cap, the cap can no longer been used and the fact that it has been tampered with is immediately discerned by even a cursory examination of the fluid transfer drum assembly.

Referring to FIGS. 15, 16, 16A, 16B, and 16C, an alternate form of the tamper-evident cap of the invention is there illustrated and designated by the numeral 85. Cap 85 is of virtually identical construction to cap 38 save for the fact that the guide segments or lands 85*a* are circumferentially spaced in a manner such that they can be guidably received within the cutout relief openings 44*a* in provided in flange 44 of three-cam, left-turn cam ring 40 (FIG. 9).

More particularly, tamper evident cap 85 includes a top wall 87 having a frangible strip 84, which in a manner presently to be described, can be removed to enable removal of the tamper-evident cap from the valve assembly of the invention. Cap 85 also includes a yieldably deformable skirt portion 85*b* which is connected to and extends downwardly from top wall 87 in the manner best seen in FIG. 16A. Like cap 38, cap 85 also includes locking means for lockably engaging the capture surfaces of a selected connector ring to prevent removal of the cap therefrom until segment 84 has been broken away from the top wall 87 to permit skirt portion 85*b* to be deformed inwardly a sufficient distance to allow removal thereof from the coupler receiving opening.

In the embodiment of the invention shown in FIGS. 15 and 16A, this important locking means comprises a circumferentially extending flange 85*c* which extends between and is interconnected with three circumferentially spaced guide lands 85*a*. Top wall 87 of cap 85 is also provided with a part of spaced-apart striations which extend along the marginal portions of removable segment 80. As before, striations 85*e* permit easy removal of removable section 84 by exerting an upward force on a removal tab 85*f*, which also forms a part of the tamper-evident cap 85. To provide structural integrity to tamper-evident cap 85, a plurality of radially outwardly extending rib-like members 85*g* are connected to the upper surface of top 87 (FIGS. 16 and 16A).

By comparing the tamper evident cap shown in FIG. 15 with the three-cam, left turn connector ring 40 shown in FIG. 9, it can be seen that cap 85 is adapted to mate with ring 40 so that guide lands 85*a* are guidably received within the cutout relief portions 44*a* provided in flange 44 of ring 40. With this construction, with the tamper-evident cap 85 correctly positioned relative to cam ring 40, a downward movement of the cap into mating engagement with ring 40 followed by the exertion of a downward force on the cap will cause portions of locking flange 85*c* to snap under capture surfaces 47 thereby securing cap 85 to ring 40 in a manner to prevent its removal therefrom so long as cap 85 remains in tact.

Turning next to FIGS. 17, 18, and 18A, still another form of the tamper-evident cap of the invention is there illustrated generally designated by the numeral 91. Once again, cap 91 is of the same general configuration as the previously described tamper-evident caps, but includes four circumferentially spaced guide segments or lands 91*a* which are strategically spaced so as to be receivable within cutout relief openings 60*a* provided in flange 60 of ring 56 and within relief openings 47 provided in flange 72 of ring 68.

Cap 91 includes a top wall 93 which has a frangible strip 94, which like segments 80 and 84, can be removed to enable removal of the tamper-evident cap from the valve assembly of the invention. Cap 91 has a yieldably deformable skirt portion 91*b* which is connected to and extends downwardly from top wall 93 in the manner best seen in FIG. 18A. Cap 91 also includes locking means in the form of locking flange 91*c* for lockably engaging the capture surfaces of a selected connector ring to prevent removal of the cap therefrom until segment 94 has been broken away from the top wall by pulling on tab 94*a* to permit skirt portion 91*b* to be deformed inwardly a sufficient distance to allow removal thereof from the coupler receiving opening. To provide structural integrity to tamper-evident cap 91, a plurality of radially outwardly extending rib-like members 91*f* are connected to the under surface of top wall 93 (FIGS. 18 and 18A).

By comparing the tamper evident cap shown in FIG. 17 with the four cam connector rings 56 and 68 shown in FIGS. 10 and 11, it can be seen that cap 91 is adapted to make both of these with rings so that guide lands 91*a* are guildably received within the four cutout relief portions 97 provided in the flanges of each four cam rings. With this construction, with the tamper-evident cap 91 properly positioned relative to either of the cam rings 56 or 68, a downward movement of the cap into mating engagement with the rings followed by the exertion of a downward force on the cap will cause portions of locking flange 91*c* to snap under capture surfaces 66 or 75 of the ring thereby securing cap 91 to the rings in a manner to prevent its removal from therefrom so long as cap 91 remains in tact.

Figure 21:
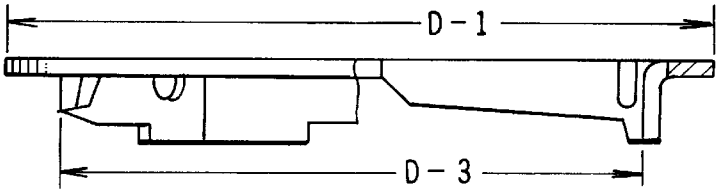
FIG. 21 is a side-elevational view of a cam-ring component of a first outside diameter.
Figure 22:
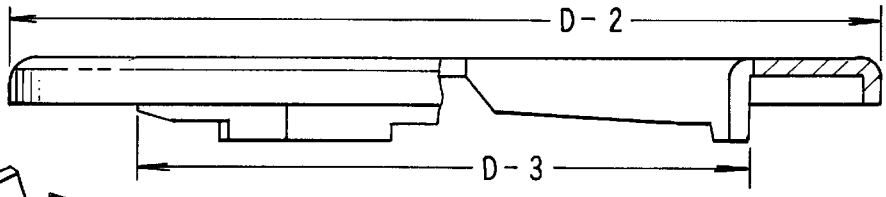
FIG. 22 is a side elevational view, partly in cross-section, of a cam ring component having a second outside diameter larger than the first diameter of the cam ring component shown in FIG. 21.

Turning to FIGS. 21 and 22, it is to be observed that the connector rings of the invention can be provided in configuration exhibiting various outside dimensions such as dimension D-1 shown in FIG. 21 and dimension D-2 shown in FIG. 22. However in all cases, the inside diameter shown in both FIGS. 21 and 22 as B-3 remains precisely the same so that the rings can be received within standard valve assemblies and will accept tamper-evident caps of the same general construction described in the preceding paragraphs.

In practicing the present invention, an appropriate valve assembly 20 of the character shown in FIG. 7 is first fabricated. As previously mentioned, valve assembly 20 is similar in construction and operation to the prior art Micro Matic valve extraction assembly previously discussed and reference should be had to Micro Matic, U.S.A. technical publications for the details for construction and operation of the valve assembly. Suffice to say that the valve assembly is constructed so as to have a generally, cylindrically shaped mouth or opening to receive an appropriate connector ring and an externally threaded neck adapted to threadably mate with the up-standing neck 19 provided on the liquid container. As previously mentioned, the valve assembly includes an elastomeric sealing member 22 which is continuously biased toward a closing position by biasing means shown here as a coil spring 101. Coil spring 101 seats within a cup-like housing 103, with one end of the spring resting against a shoulder 105 formed in housing 103 and the upper end of the spring residing in engagement with metal insert 107 which engages elastomeric sealing member 22. A downtube 109 which is similar in construction to downtube "DT" of the apparatus shown in FIG. 1 is connected to housing 103 and extends downwardly therefrom.

Once the valve assembly 20 is properly fabricated, one of the connector rings of the invention is selected and is interconnected with the neck portion of the valve by any suitable means such as welding. More particularly, depending upon the customer for which the system is being provided, a three-cam, right-turn ring such as ring 24 can be interconnected with the valve assembly. For another customer, a three-cam, left-turn ring such as ring 40 may be select for interconnection with the valve assembly. For still another customer, a four-cam, right-turn ring such as ring 56 may be interconnected with valve assembly 20 or alternatively, a four-cam, left-turn connector ring such as ring 68 may be interconnected with the valve assembly.

Once the proper connector ring has been affixed to the appropriate valve assembly, the valve assembly can be threadably interconnected with the liquid container with the external threads on the valve assembly threadably mating with the internal threads provided on neck 19 of the liquid storage container.

The next step in the practice of the invention is to fabricate an appropriate coupler assembly 28 to be used in connection with the particular valve assembly that has been fabricated. The coupler assembly 28 is of the general construction shown in FIG. 5 and, once again, is similar in construction to the previously described Micro Matic U.S.A., Inc. coupler assemblies of the character shown in FIG. 1. The unique aspect of the coupler assemblies of the present invention resides in the selection and placement of the locking pins which are to mateably interengage with the connector rings that have been interconnected with the valve assembly of the invention. For example, when the three-cam, right-turn ring 24 has been interconnected with an appropriate valve assembly, a coupler such as the coupler shown in FIGS. 5, 5A, and 6 is fabricated for use in connection with this particular valve assembly. As shown in FIGS. 5 and 6, this particular coupler assembly is fabricated so as to have three circumferentially spaced locking pins 50 which will interengage with three-cam, right-turn rings 24 of the character shown in FIG. 8. With this construction, rotation of the coupler in a clockwise or right-turn direction will cause pins 50 to ride along cam surfaces 32 and urge the coupler into sealable interconnection with the valve assembly which incorporates the three-cam, right-turn connector ring 24.

Figure 12:
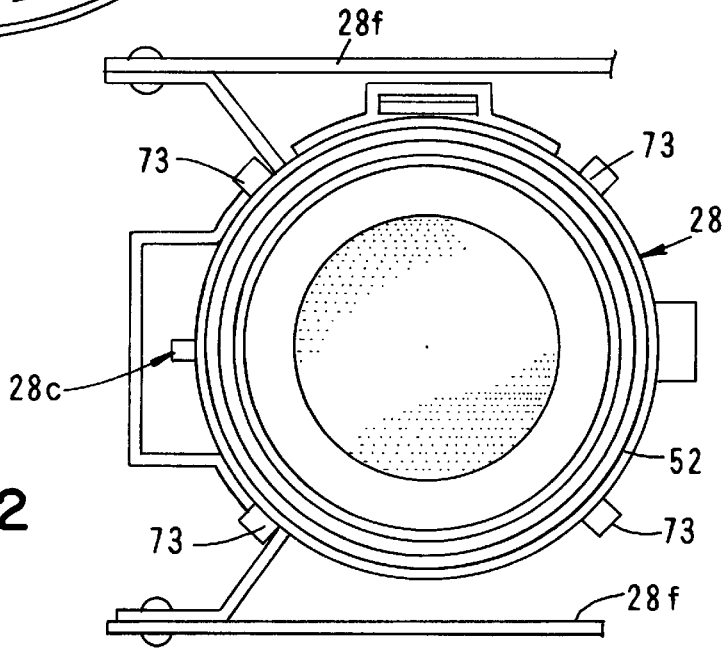
FIG. 12 is a bottom view of a coupler mechanism similar to that shown in FIGS. 5 and 6, but embodying four pins rather than three so that the coupler will mate with the cam ring components shown in FIGS. 10 and 11.

Alternatively, when either a four-cam, right-turn or four-cam left-turn ring such as those shown in FIGS. 10 and 11 is selected for interconnection with the valve assembly, a coupler assembly of the character shown in FIG. 12 will be fabricated. This coupler assembly includes four locking pins 73 which are equally spaced about the lower periphery of the coupler assembly. Locking pins 73 are constructed and arranged to mate with and slide along the cam surfaces 64 and 76 of the cam rings shown in FIGS. 10 and 11. More particularly, rotation of the coupler in a right-turn direction relative to four-cam, right-turn connector ring 56 will bring the coupler into sealable interconnection with the valve assembly. Conversely, rotation of the coupler assembly in a counterclockwise or left turn with respect to four-cam, left-turn connector ring 68, will permit the coupler assembly to be sealably mated with the valve assembly.

As previously discussed, it is apparent that depending upon the particular cam ring and the particular coupler design selected for a given customer, that customer can be provided with a uniquely customized system which is unable to be used by competitors having differently configured connector rings and/or coupler assemblies. In this way, the liquid transfer system for a particular customer can be unique to that customer and can be used only by that customer.

Once the coupler assembly of the invention is interconnected with the appropriate valve assembly of the invention, a construction similar to that shown in FIG. 3 is created. When it is desired to remove the liquid contents from the liquid container 14, the operating lever 28*c* of the coupler system (FIG. 5) is moved to a downward position in the same manner as generally illustrated in FIG. 4 of the drawings. This downward movement of the operating lever 28*c* causes the actuator sleeve 28*b* of the coupler assembly to engage the valve mechanism in a manner to move the elastomeric sealing ring assembly 22 downwardly against the urging of compression spring 101. Upon moving the elastomeric sealing member assembly 22 away from the valve seat, liquid can be pumped from the fluid container in the manner previously described using a remotely located pumping system (not shown).

Referring to FIG. 5*a*, it is to be noted that a novel valving means is incorporated into the coupler assembly 28 to permit air to be drawn into the liquid container during the pumping operation. This valving means is here provided in the form of a conventional umbrella-type valve assembly generally designated in FIG. 5 by the numeral 28*c*. Umbrella valve assembly 28*c* comprises an elastomeric, yieldably deformable umbrella member 28*d* which is normally maintained in a closed position covering vent apertures 28*e* which are provided in the housing of the coupler assembly in the manner shown in FIG. 5A. During the pumping operation, valve member 28*d* will be moved from the valve closed position shown in the solid lines in FIG. 5A into the position into the position shown by the phantom lines in FIG. 5A so that air can be drawn into the liquid container through the vent ports in the manner illustrated by the arrows of FIG. 5A.

It is to be understood that, when the liquid container 14 of the system is either full or empty, a tamper evident cap of the character described in the preceding paragraphs can be used to close the access opening to the liquid container. More particularly, the tamper-evident cap can be interconnected with the filled container 14 after filling so that access to the container via the appropriate coupler of the invention cannot be achieved unless and until the frangible strip is removed from the cap to enable the cap to be removed in its entirety from the access opening. Once this is accomplished, of course, the coupler assembly can be readily mated with the valve assembly in the manner described in the preceding paragraphs.

In a similar fashion, after the contents of the liquid container have been removed, a new tamper-evident cap can be inserted into the access opening of the assembly to positively prevent tampering with, or gaining access to the interior of container 14, unless the tamper-evident cap is destroyed in some manner, such as by removing the frangible strip therefrom. Since each of the systems owned by a particular customer requires the use of a particularly configured tamper-evident cap, only appropriate caps provided to that customer can be used by the customer to seal either the filled or empty liquid transport containers or drums 14.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

I claim:

1. A tamper evident cap for use in combination with a liquid dispensing system comprising a container having an access opening in communication with an internal chamber for containing the liquid to be dispensed and a dispensing valve mounted within the access opening, the dispensing valve including a body portion having a coupler receiving opening provided with a capture surface, the tamper evident cap functioning to close the coupler receiving opening and comprising:

(a) a top wall including a removable segment; and (b) a yieldably deformable skirt portion connected to and circumscribing said top wall, said skirt portion including locking means for lockably engaging the capture surface of the coupler receiving opening to prevent removal of said cap therefrom until said removable segment is removed to permit said skirt portion to be inwardly deformed a sufficient distance to allow removal thereof from the coupler receiving opening.

2. A tamper evident cap as defined in claim 1 in which said top wall is generally circular and in which said segment comprises a frangible strip extending at least partially across the diameter of said top wall.

3. A tamper evident cap as defined in claim 1 in which said locking means comprises an outwardly extending flange having an engaging surface engageable with the capture surface of the coupler receiving opening.

4. A tamper evident cap as defined in claim 2 in which the coupler receiving opening includes a plurality of circumferentially spaced slots and in which said skirt portion comprises a plurality of circumferentially spaced guide segments alignable with said plurality of circumferentially spaced slots.

5. A tamper evident cap as defined in claim 4 in which said skirt portion comprises three circumferentially spaced guide segments.

6. A tamper evident cap as defined in claim 4 in which said skirt portion comprises four circumferentially spaced guide segments.

7. A tamper evident cap for use in combination with a liquid dispensing system comprising a container having an access opening in communication with an internal chamber for containing the liquid to be dispensed and a dispensing valve mounted within the access opening, the dispensing valve including a body portion having a coupler receiving opening provided with a capture surface, the tamper evident cap functioning to close the coupler receiving opening and comprising:

(a) a generally circular shaped top wall including a removable strip like segment, said strip like segment extending diametrically of said wall and terminating at one end in an outwardly extending pull tab; and (b) a yieldably deformable skirt portion connected to and circumscribing said top wall, said skirt portion including locking means for lockably engaging the capture surface of the coupler receiving opening to prevent removal of said cap therefrom until said removable segment is removed by pulling on said pull tab to permit said skirt portion to be radially inwardly deformed a sufficient distance to allow removal thereof from the coupler receiving opening.

8. A tamper evident cap as defined in claim 7 in which said top wall is substantially bisected by said strip like segment.

9. A tamper evident cap as defined in claim 7 in which said locking means comprises an outwardly extending flange having an engaging surface engageable with the capture surface of the coupler receiving opening.

10. A liquid dispensing system comprising:

(a) a container having an internal compartment for containing the liquid to be dispensed, said container having an access opening providing access to said internal compartment;

(b) an extractor valve removably mounted within said access opening, said extractor valve including a closure member movable from a closed position to an open position and a connector ring receivable within said access opening, said connector ring comprising:

(i) a generally circular shaped flange;

(ii) a plurality of circumferentially spaced cam defining walls depending from said flange, each said cam defining walls including a camming surface and a capture surface;

(c) a tamper evident cap removably connected to said connector ring to temporarily close said access opening, said cap having a frangible surface which is breakable to permit removal of said cap from said access opening; and (d) coupler means for interconnection with said connector ring when said tamper evident cap is removed from said access opening, said coupler means functioning to move said closure member of said extractor valve from said closed position to said open position.

11. A system as defined in claim 10 in which said tamper evident cap comprises:

(a) a top wall including a removable segment; and (b) a yieldably deformable skirt portion connected to and circumscribing said top wall, said skirt portion including locking means for lockably engaging the capture surface of said connector ring to prevent removal of said cap therefrom until said removable segment is removed to permit said skirt portion to be inwardly deformed a sufficient distance to allow removal thereof from the coupler receiving opening.

12. A system as defined in claim 11 in which said connector ring includes three circumferentially spaced cam defining walls and three circumferentially spaced apart coupler pin receiving slots and in which said coupler means comprises a coupler body having three circumferentially spaced cam engaging pins indexable with said coupler pin receiving slots.

13. A system as defined in claim 11 in which said connector ring includes four circumferentially spaced cam defining walls and four circumferentially spaced apart coupler pin receiving slots and in which said coupler means comprises a coupler body having four circumferentially spaced cam engaging pins indexable with said coupler pin receiving slots.

14. A tamper evident cap as defined in claim 11 in which said top wall is generally circular and in which said segment comprises a frangible strip extending at least partially across the diameter of said top wall.

15. A tamper evident cap as defined in claim 11 in which said locking means comprises an outwardly extending flange having an engaging surface engageable with the capture surface of the coupler receiving opening.

16. A tamper evident cap as defined in claim 15 in which the coupler receiving opening includes a plurality of circumferentially spaced slots and in which said skirt portion comprises a plurality of circumferentially spaced guide segments alignable with said plurality of circumferentially spaced slots.

* * * * *